US009572372B2

(12) United States Patent
Liu

(10) Patent No.: US 9,572,372 B2
(45) Date of Patent: Feb. 21, 2017

(54) BATTERY ASSEMBLY AND ELECTRONIC CIGARETTE COMPRISING THE SAME

(71) Applicant: Qiuming Liu, Guangdong (CN)

(72) Inventor: Qiuming Liu, Guangdong (CN)

(73) Assignee: HUIZHOU KIMREE TECHNOLOGY CO., LTD. SHENZHEN BRANCH, Shenzhen (CN)

( * ) Notice: Subject to any disclaimer, the term of this patent is extended or adjusted under 35 U.S.C. 154(b) by 491 days.

(21) Appl. No.: 14/057,173

(22) Filed: Oct. 18, 2013

(65) Prior Publication Data

US 2015/0047659 A1 Feb. 19, 2015

(30) Foreign Application Priority Data

Aug. 16, 2013 (CN) ..... 2013 2 0504239

(51) Int. Cl.
*A24F 47/00* (2006.01)

(52) U.S. Cl.
CPC ..... *A24F 47/008* (2013.01)

(58) Field of Classification Search
CPC ..... A24F 47/008
USPC ..... 320/114–115
See application file for complete search history.

(56) References Cited

U.S. PATENT DOCUMENTS

2002/0041177 A1* 4/2002 Okuda ..... B62J 11/00 320/112
2011/0226236 A1* 9/2011 Buchberger ..... A61M 11/041 128/200.23
2011/0277756 A1* 11/2011 Terry ..... A61M 15/06 128/202.21
2012/0187902 A1* 7/2012 Wang ..... H02J 7/00 320/107
2013/0169230 A1* 7/2013 Li ..... A24F 47/008 320/114
2013/0192615 A1* 8/2013 Tucker ..... H01C 17/00 131/328
2014/0261493 A1* 9/2014 Smith ..... A24F 47/008 131/328
2015/0020831 A1* 1/2015 Weigensberg ..... A24F 47/008 131/329

* cited by examiner

*Primary Examiner* — Michael H Wilson
*Assistant Examiner* — Eric Yaary
(74) *Attorney, Agent, or Firm* — Tim Tingkang Xia, Esq.; Locke Lord LLP

(57) ABSTRACT

A battery assembly configured to cooperate with an atomizing assembly to form an electronic cigarette is provided; and the battery assembly comprises a sleeve, a battery disposed along an axial direction of the sleeve, and an end cover mounted on an end of the sleeve; the end cover is telescopically connected to the sleeve; and a first charging electrode and a second charging electrode are mounted on the end cover and arranged in the sleeve; the first charging electrode and the second charging electrode are configured to be exposed and connected to an external charger when the end cover extends out of the sleeve, thereby providing charging electric power to the battery. In the present application, outside impurities cannot adhere to the atomizing assembly, and the normal working of the electronic cigarette cannot be adversely affected by the impurities.

2 Claims, 11 Drawing Sheets

BATTERY ASSEMBLY AND ELECTRONIC CIGARETTE COMPRISING THE SAME

CROSS-REFERENCE TO RELATED APPLICATION

This application claims priority of application No. 201320504239.3, filed on Aug. 16, 2013 in the Intellectual Property Office of The Republic of China, which is incorporated by reference herein in its entirety.

FIELD OF THE INVENTION

The present application relates to the field of daily electrical products, and more particularly relates to a battery assembly comprising an end cover that can be connected to a charger, and an electronic cigarette comprising the battery assembly.

BACKGROUND OF THE INVENTION

An electronic cigarette comprises a battery assembly and an atomizing assembly. The battery assembly is configured to supply electric power to the atomizing assembly of the electronic cigarette. Electronic cigarettes are classified as disposable electronic cigarettes and non-disposable electronic cigarettes. In a disposable electronic cigarette, a battery of the battery assembly cannot be charged. As the disposable electronic cigarette doesn't have a charging function, tobacco tar of the disposable electronic cigarette is often unable to be exhausted when the disposable electronic cigarette is used.

In a non-disposable electronic cigarette, a battery of the battery assembly can be charged. FIG. 1 is a schematic view of charging principle of a non-disposable electronic cigarette in the prior art. In the rechargeable battery of the non-disposable electronic cigarette, the charging interface of the rechargeable battery is disposed on a connection portion between the battery assembly and the atomizing assembly. When the battery is charged, the atomizing assembly needs to be detached from the battery assembly, so that two charging terminals of the battery are exposed. Thus, when the battery is charged, the atomizing assembly is not connected with a controller of the non-disposable electronic cigarette and the battery. By adopting the non-disposable electronic cigarette that needs to detach the atomizing assembly from the battery assembly when it is charged, the charging operation spends much time and much work, and the connection portion between the atomizing assembly and the battery assembly may loose after use for a long time. Furthermore, detaching the atomizing assembly may cause the atomizing assembly to be lost, and impurities may enter the non-disposable electronic cigarette and adversely affect normal working of the non-disposable electronic cigarette in frequent detachment operations of the atomizing assembly.

SUMMARY OF THE INVENTION

The objective of the present application is to provide a battery assembly comprising an end cover that can be connected to a charger and an electronic cigarette comprising the battery assembly, aiming at defects in the prior art that the charging operation of the non-disposable electronic cigarette spends much time and much work, and impurities may often adhere to the atomizing assembly.

The technical solutions of the present application for solving the technical problems are as follows:

In one aspect, a battery assembly configured to cooperate with an atomizing assembly to form an electronic cigarette is provided; and the battery assembly comprises a sleeve, a battery disposed along an axial direction of the sleeve, and an end cover mounted on an end of the sleeve; the end cover is telescopically connected to the sleeve; and a first charging electrode and a second charging electrode are mounted on the end cover and arranged in the sleeve;

the first charging electrode and the second charging electrode are configured to be exposed and connected to an external charger when the end cover extends out of the sleeve, thereby providing charging electric power to the battery.

In one embodiment, the end cover includes a cover body mounted on the sleeve and a connecting portion extending towards the sleeve along an axial direction of the cover body; and the first charging electrode and the second charging electrode are mounted on an outer surface of the connecting portion and spaced with each other.

In another embodiment, the battery assembly further comprises a controller; a first accommodating house configured for accommodating the connecting portion, a second accommodating house configured for accommodating the controller, and a third accommodating house located between the first accommodating house and the second accommodating house and configured for accommodating elastic conductive wires are formed between the battery and the end cover;

an end of the first charging electrode abutting the third accommodating house and an end of the second charging electrode abutting the third accommodating house are respectively connected to the elastic conductive wires.

In another embodiment, both the first charging electrode and the second charging electrode run through an outer surface of the connecting portion axially, and extend from a side of the connecting portion away from the cover body.

In another embodiment, the first charging electrode and the second charging electrode are respectively a first electrode plate and a second electrode plate that are both mounted on the outer surface of the connecting portion.

In another embodiment, the battery assembly further comprises a connecting member disposed between the sleeve and the connecting portion; the connecting member is received in the sleeve, and is telescopically connected with the connecting portion.

In another embodiment, the connecting member is connected to the connecting portion by threads; an external thread is formed on the outer surface of the connecting portion, and an internal thread corresponding to the external thread is formed on an inner surface of the connecting member.

In another embodiment, the connecting portion is buckled with the connecting member.

In another embodiment, a buckling recess is defined in the outer surface of the connecting portion, and a buckling block corresponding to the buckling recess is formed on a side surface of an end of the connecting member and extends away from the sleeve along a radial direction of the connecting member.

In another embodiment, a buckling pillar is formed on the outer surface of the connecting portion and extends away from the connecting portion along a radial direction of the connecting portion; a guiding recess configured to lead the buckling pillar to radially slide is defined in the inner surface of the connecting member; and a sliding distance of the buckling pillar sliding in the guiding recess is equal to a critical distance of the end cover extending out of the sleeve;

wherein, in a normal state, the buckling pillar abuts against a portion of an end of the connecting member abutting the battery assembly that is far away from the opening of the guiding recess; and when the electronic cigarette needs to be charged, the end cover is rotated until the buckling pillar is buckled with the guiding recess, and the end cover is pulled out.

In another embodiment, an annular flange is formed on a circumferential side surface of an end of the connecting member, and extends away from the connecting portion along a radial direction of the connecting portion; and the annular flange is configured to abut against an end of the sleeve when the connecting member is embedded in the sleeve.

In another embodiment, an external diameter of the annular flange is equal to an external diameter of the sleeve.

In another embodiment, the battery assembly further comprises a stopping block coaxially fixed on an end of the connecting portion away from the end cover, and the stopping block is configured to limit a distance of the connecting portion extending out of the sleeve.

In another aspect, an electronic cigarette comprising an atomizing assembly and a battery assembly is provided; and the battery assembly comprises a sleeve, a battery disposed along an axial direction of the sleeve, and an end cover mounted on an end of the sleeve; the end cover is telescopically connected to the sleeve; and a first charging electrode and a second charging electrode are mounted on the end cover and arranged in the sleeve;

the first charging electrode and the second charging electrode are configured to be exposed and connected to an external charger when the end cover extends out of the sleeve, thereby providing charging electric power to the battery.

In one embodiment, the end cover includes a cover body mounted on the sleeve and a connecting portion extending towards the sleeve along an axial direction of the cover body; and the first charging electrode and the second charging electrode are mounted on an outer surface of the connecting portion and spaced with each other; the battery assembly further comprises a connecting member disposed between the sleeve and the connecting portion; the connecting member is received in the sleeve, and is telescopically connected with the connecting portion.

In another embodiment, the connecting member is connected to the connecting portion by threads; an external thread is formed on the outer surface of the connecting portion, and an internal thread corresponding to the external thread is formed on an inner surface of the connecting member.

In another embodiment, the connecting portion is buckled with the connecting member; a buckling recess is defined in the outer surface of the connecting portion, and a buckling block corresponding to the buckling recess is formed on a side surface of an end of the connecting member and extends away from the sleeve along a radial direction of the connecting member.

In another embodiment, the connecting portion is buckled with the connecting member; a buckling pillar is formed on the outer surface of the connecting portion and extends away from the connecting portion along a radial direction of the connecting portion; a guiding recess configured to lead the buckling pillar to radially slide is defined in the inner surface of the connecting member; and a sliding distance of the buckling pillar sliding in the guiding recess is equal to a critical distance of the end cover extending out of the sleeve;

wherein, in a normal state, the buckling pillar abuts against a portion of an end of the connecting member abutting the battery assembly that is far away from the opening of the guiding recess; and when the electronic cigarette needs to be charged, the end cover is rotated until the buckling pillar is buckled with the guiding recess, and the end cover is pulled out.

In another embodiment, an annular flange is formed on a circumferential side surface of an end of the connecting member, and extends away from the connecting portion along a radial direction of the connecting portion; and the annular flange is configured to abut against an end of the sleeve when the connecting member is embedded in the sleeve.

In another embodiment, the battery assembly further comprises a stopping block coaxially fixed on an end of the connecting portion away from the end cover, and the stopping block is configured to limit a distance of the connecting portion extending out of the sleeve.

When implementing the battery assembly and the electronic cigarette comprising the battery assembly, the following advantageous effects can be achieved: since the charging electrode is mounted on the end cover, when the battery is charged, only a portion of the end cover needs to extend out of the sleeve to expose the first charging electrode and the second charging electrode. By connecting the first charging electrode and the second charging electrode with corresponding charging terminals of an external charger respectively, charging electric power can be provided to the battery. In this charging method, the charging operation is easy, and the atomizing assembly cannot be exposed. Thus, outside impurities cannot adhere to the atomizing assembly, and the normal working of the electronic cigarette cannot be adversely affected by the impurities, so that a reliable connection between the battery assembly and the atomizing assembly can be ensured.

BRIEF DESCRIPTION OF THE DRAWINGS

The present application will be further described with reference to the accompanying drawings and embodiments in the following, in the accompanying drawings.

DETAILED DESCRIPTION OF THE PREFERRED EMBODIMENT

To make the technical feature, objective and effect of the present application be understood more clearly, now the specific implementation of the present application is described in detail with reference to the accompanying drawings and embodiments.

The objective of the present application is to provide a battery assembly comprising an end cover connected to a charger and an electronic cigarette comprising the battery assembly, aiming at defects that the charging operation of the electronic cigarette spends much time and much work, and impurities can adhere to the atomizing assembly in prior art. The electronic cigarette of the present application can be an electronic cigarette comprising an atomizing assembly and a battery assembly that are detachable from each other, and can also be a disposable electronic cigarette comprising an atomizing assembly and a battery assembly that share a sleeve.

The battery assembly is configured to cooperate with the atomizing assembly to form the electronic cigarette. The battery assembly comprises a sleeve, a battery disposed along an axial direction of the sleeve, and an end cover mounted on an end of the sleeve. The end cover is telescopically connected to the sleeve. A first charging electrode and a second charging electrode are mounted on the end cover and received in the sleeve. The first charging electrode and the second charging electrode are configured to be exposed and connected to an external charger when the end cover partially extends out of the sleeve, so that charging electric power is supplied to the battery.

Figure 1:
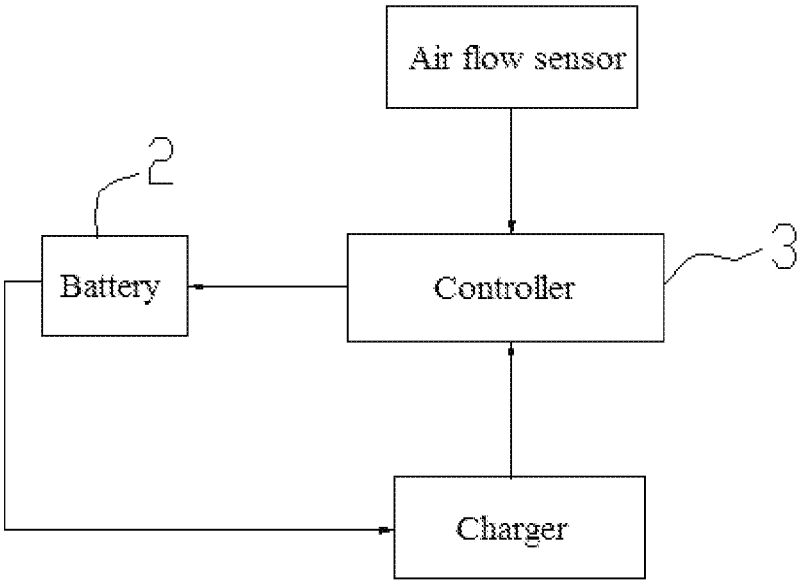
FIG. 1 is a schematic view of charging principle of an electronic cigarette in the prior art.
Figure 2:
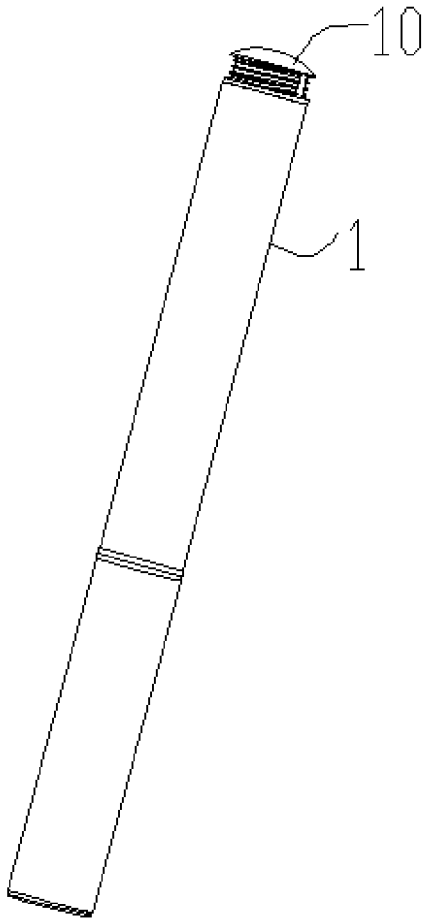
FIG. 2 is a structural schematic view of an electronic cigarette of a first embodiment of the present application.

FIG. 2 is a structural schematic view of an electronic cigarette of a first embodiment of the present application.

Figure 5:
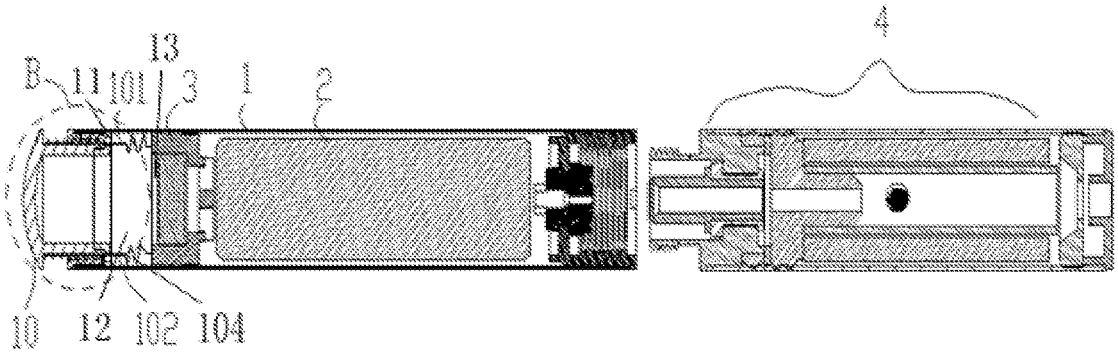
FIG. 5 is a schematic assembly view of the electronic cigarette of the first embodiment of the present application.

The electronic cigarette of the present application comprises a battery assembly. The battery assembly includes a sleeve 1 and an end cover 10 mounted on an end of the sleeve 1. When the electronic cigarette is charged, only a portion of the end cover 10 needs to extend out of the sleeve 1. FIG. 2 shows the situation that the end cover 10 extends out of the sleeve 1 when the electronic cigarette is charged. As shown in FIG. 5, the electronic cigarette mainly comprises the battery assembly and an atomizing assembly 4, and the battery assembly includes a battery 2 and a controller 3. In this embodiment, the end cover 10 is a lamp cap disposed at a side of a lamp (not shown) configured to simulate burning tobacco.

Figure 3:
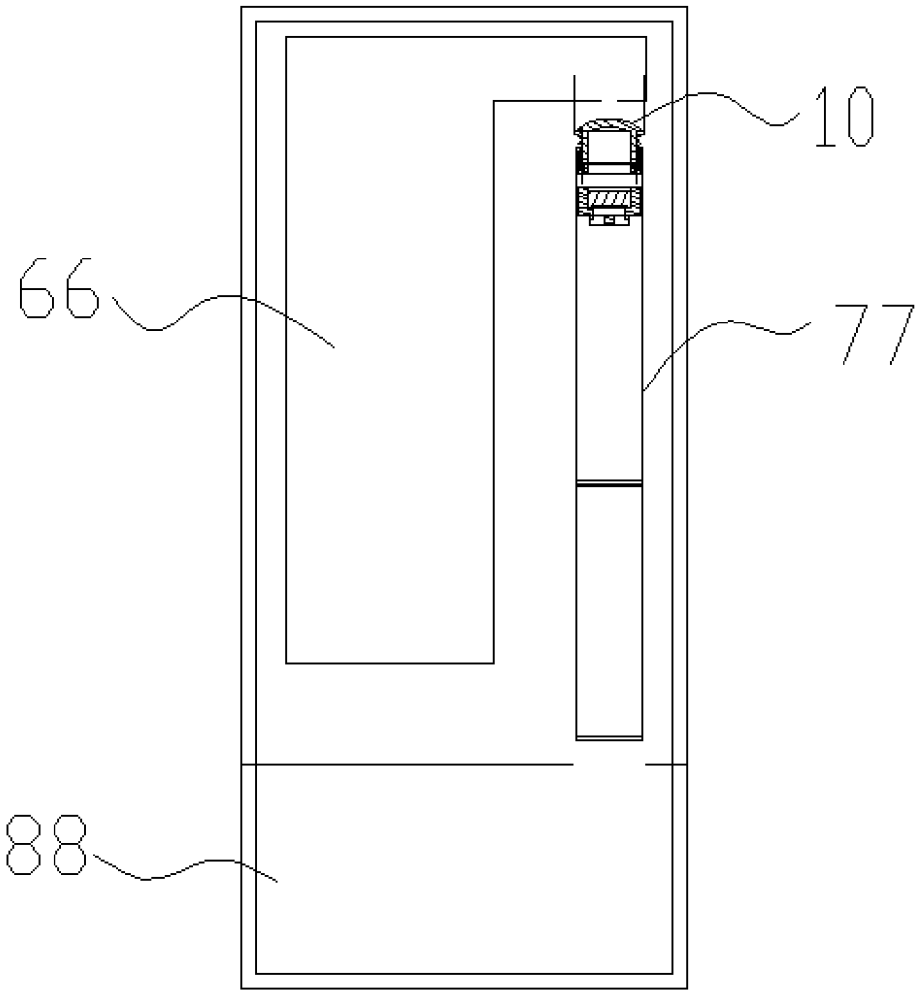
FIG. 3 is a structural schematic view of an electronic cigarette of the present application in a charging process.
Figure 4:
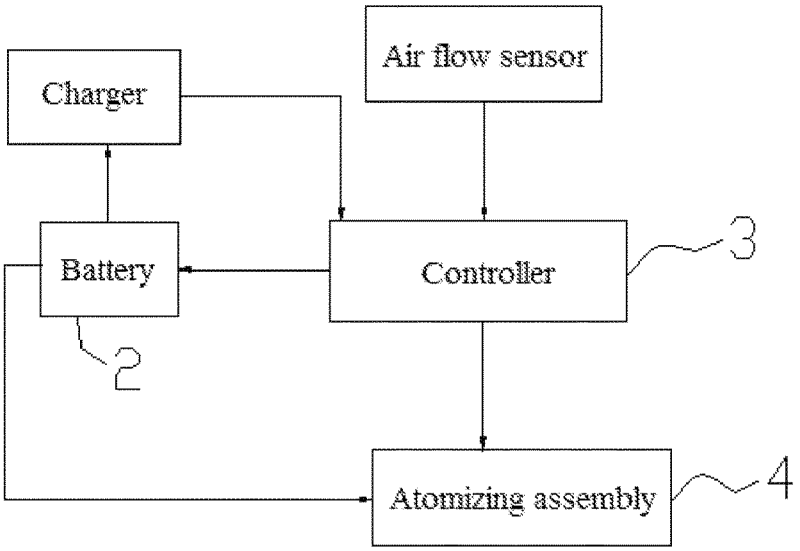
FIG. 4 is a schematic view of charging principle of the electronic cigarette of the present application.

FIG. 3 shows a structural schematic view of an electronic cigarette of the present application in a charging process. FIG. 4 is a schematic view of charging principle of the electronic cigarette of the present application.

When the electronic cigarette 77 is charged via an electronic cigarette case 88, the end cover 10 is partially screwed out of or pulled out of the sleeve 1 to expose two charging electrodes (i.e., a first charging electrode 101 and a second charging electrode 102 mentioned as follows), and charging terminals of a PCB 66 are buckled with the end cover 10, so that the two charging electrodes are respectively connected to corresponding charging terminals. Because the atomizing assembly 4 doesn't need to be detached when the electronic cigarette of the present application is electrically connected to a charger, the atomizing assembly 4 is still mechanically connected to the battery assembly.

When the electronic cigarette 77 works normally, a controller 3 controls the battery 2 to supply electric power to the atomizing assembly 4 according to air flow signals detected by an air flow sensor, and further controls particular atomizing work of the atomizing assembly 4. When the battery 2 is charged, charging terminals of an external power supply (i.e., charging terminals of a PCB 66 of the electronic cigarette case 88) are respectively electrically connected to the controller 3 via the charging electrodes. Thus, the controller 3 controls the external power supply to supply electric power to the battery 2. Meanwhile, the atomizing assembly 4 is still mechanically connected with the battery assembly; however, the controller 3 stops the battery 2 supplying electric power to the atomizing assembly 4, so that the atomizing assembly 4 stops working.

Figure 6:
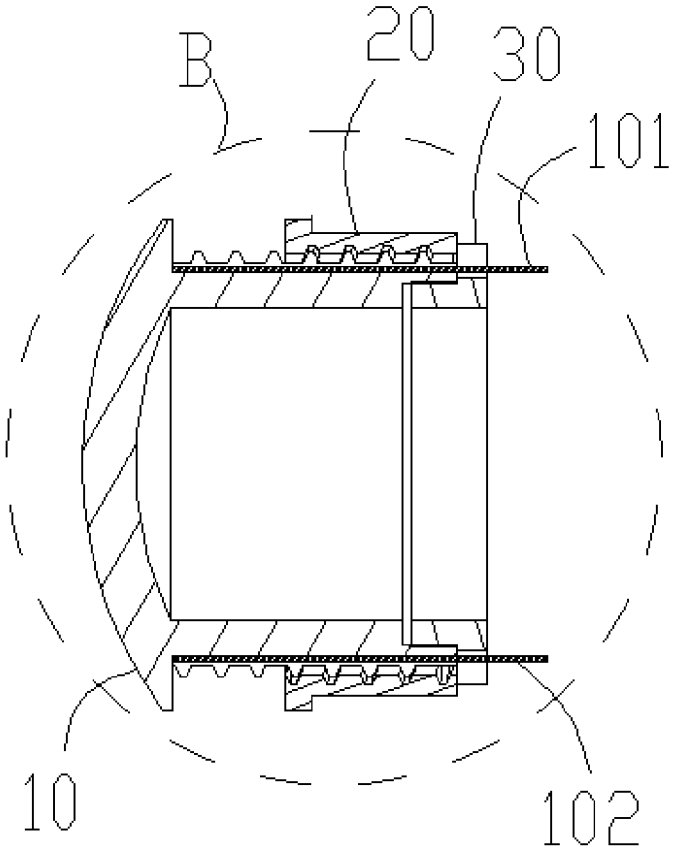
FIG. 6 is an enlarged view of the portion B shown in FIG. 5.
Figure 7:
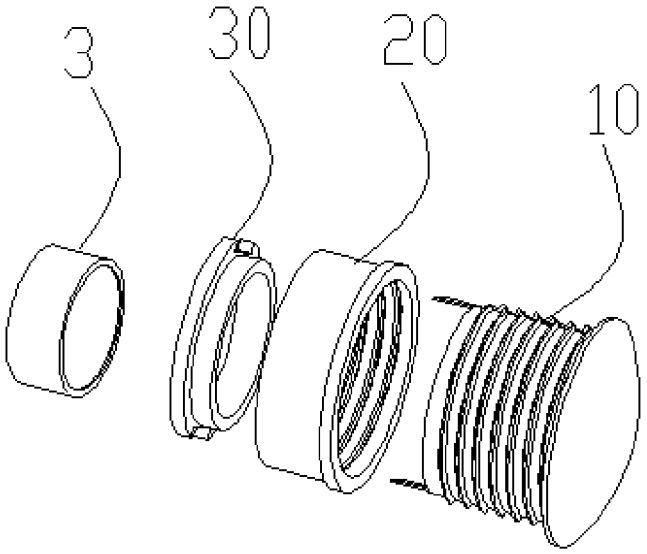
FIG. 7 is an exploded view of an end cover shown in FIG. 5.

The specific structures of the end cover of the electronic cigarette in the present application are introduced as follows:

FIG. 5 shows is a schematic assembly view of the electronic cigarette of the first embodiment of the present application. FIG. 6 is an enlarged view of the portion B shown in FIG. 5. FIG. 7 is an exploded view of an end cover shown in FIG. 5.

In a first embodiment, the electronic cigarette comprises the battery assembly, and the battery assembly includes an end cover 10, a connecting member 20, and a stopping block 30.

The battery assembly further comprises a battery 2 disposed along an axial direction of the sleeve, and a controller 3. A first accommodating house 110 configured for accommodating a connecting portion of the end cover 10, a second accommodating house 120 configured for accommodating the controller 3, and a third accommodating house 130 located between the first accommodating house 110 and the second accommodating house 120 and configured for accommodating elastic conductive wires 104 are formed between the end cover 10 and the battery 2. In this embodiment, the two charging electrodes configured for charging are mounted on the end cover 10, the end cover 10 and the sleeve 1 are connected with each other by threads to enable the end cover 10 to be screwed out, and the charging electrodes are electrically connected to the controller 3 via conductive wires 104 to charge the battery. Thus, when the end cover 10 is screwed out to expose the charging electrodes, in order to avoid the conductive wires 104 being winded together and broken by rotations, the conductive wires 104 of the present application are spiral elastic conductive wires 104, and the third accommodating house 130 configured to accommodate the elastic conductive wires 104 is provided. Of course, the detachable connection between the end cover 10 and the sleeve 1 can be achieved by other structures, such as a buckling structure, a sliding structure, and so on, so that a portion of the end cover 10 can be directly pulled out of the sleeve 1. Therefore, the conductive wires 104 connecting the charging electrodes with the controller 3 should have enough lengths, and should be capable of being disposed in the third accommodating house 130.

The charging electrodes particularly include the first charging electrode 101 and the second charging electrode 102, and the first charging electrode 101 should be insulated from the second charging electrode 102. Therefore, the end cover 10, the connecting member 20, and stopping block 30 are all made of insulation material. In this embodiment, the insulation material is advantageously plastic. The first charging electrode 101 and the second charging electrode 102 are configured to be connected to an external charger when a portion of the end cover 10 extends out of the sleeve 1. As detailed above, an end of the first charging electrode 101 abutting the third accommodating house and an end of the second charging electrode 102 abutting the third accommodating house are respectively connected to corresponding elastic conductive wires, and the elastic conductive wires are connected to the controller 3 to supply charging electric power to the battery 2.

The first charging electrode 101 and the second charging electrode 102 can be conductive metal plates, metal lines, or metal lug bosses. When the first charging electrode 101 and the second charging electrode 102 are conductive metal plates or metal lug bosses, corresponding patterns can be formed on the conductive metal plates or the metal lug bosses to indicate polarities of the charging electrodes. For example, a positive pole can be indicated by a sign "+", and a negative pole can be indicated by a sign "−". When the first charging electrode 101 and the second charging electrode 102 are metal lines, different portions of the metal lines can be respectively marked by different colors to indicate the polarities of the charging electrodes. For example, a positive pole can be indicated by red, and a negative pole can be indicated by black. Furthermore, identifiers can be disposed on the sleeve 1. When a distance of the end cover 10 extending out of the sleeve 1 reaches a maximum stroke, the polarities of the first charging electrode 101 and the second charging electrode 102 can be determined according to the identifiers disposed on the sleeve 1.

Figure 8A:
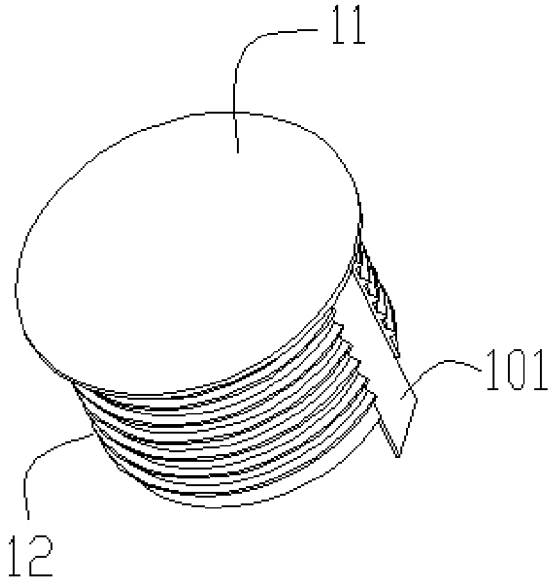
FIGS. 8A to 8C are respectively a perspective view, a front elevation view and a cut-away view of an end cover shown in FIG. 6.
Figure 8B:
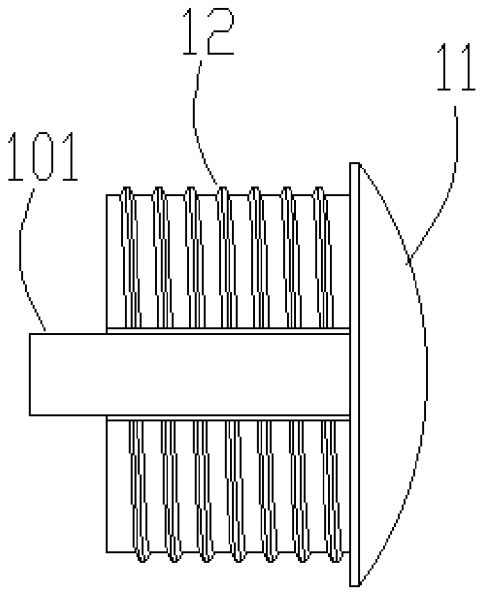
Figure 8C:
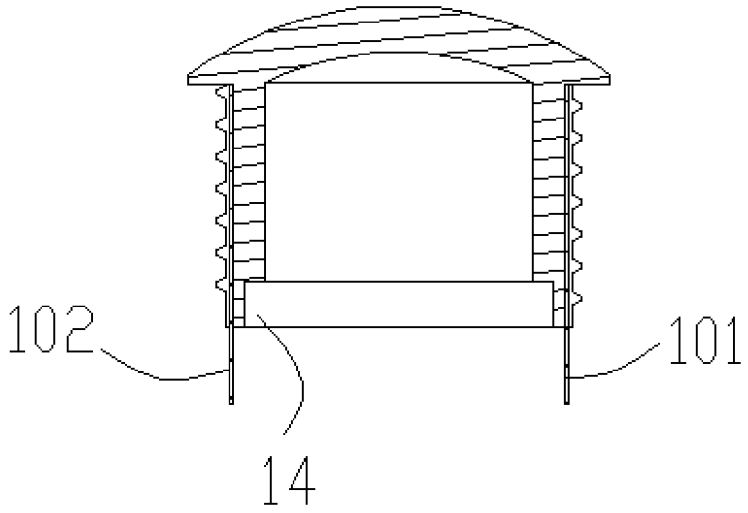

FIGS. 8A to 8C are respectively a perspective view, a front elevation view, and a cut-away view of an end cover shown in FIG. 6.

The end cover 10 includes a cover body 11 mounted on the sleeve 1, and a connecting portion 12 extending towards the sleeve 1 along an axial direction of the cover body 11. The first charging electrode 101 and the second charging electrode 102 are mounted on an outer surface of the connecting portion 12 and spaced with each other. Particularly, both the first charging electrode 101 and the second charging electrode 102 run through an outer surface of the connecting portion 12 axially, and extend from a side of the connecting portion 12 away from the cover body 11. In this embodiment, the first charging electrode 101 and the second charging electrode 102 are respectively electrode plates mounted on the outer surface of the connecting portion 12, and patterns indicating the positive polarity or the negative polarity are engraved in each of the electrode plates.

Considering the overall aesthetics of the electronic cigarette, an external diameter of the cover body 11 is equal to an external diameter of the sleeve 1. For convenience of rotating the end cover 10, a length of the outer surface of the cover body 11 measured along an axial direction is 3 mm.

Figure 9A:
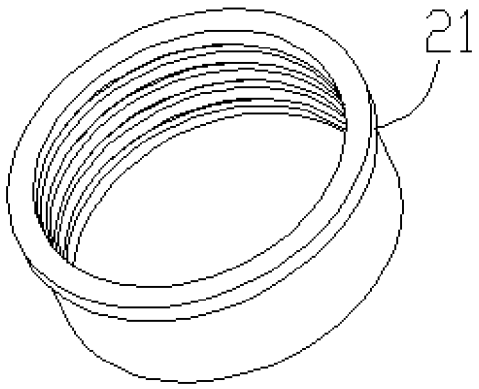
FIGS. 9A to 9B are respectively a perspective view and a front elevation view of a connecting member shown in FIG. 6.
Figure 9B:
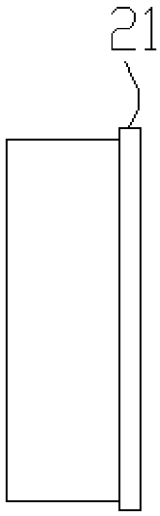

FIGS. 9A to 9B are respectively a perspective view and a front elevation view of a connecting member shown in FIG. 6.

A connecting member 20 is disposed between the sleeve 1 and the connecting portion 12. The connecting member 20 is received in the sleeve 1, and the connecting member 20 and the sleeve 1 can be connected with each other by interference fit, threaded connection, or buckling connection. The connecting member 20 is telescopically connected with the connecting portion 12 by threaded connection, sliding connection, buckling connection, etc. In the first embodiment, the threaded connection is preferred. An external thread is formed on the outer surface of the connecting portion 12, and an internal thread corresponding to the external thread is formed on an inner surface of the connecting member 20.

An annular flange 21 is formed on a circumferential side surface of an end of the connecting member 20, and extends away from the connecting portion 12 along a radial direction of the connecting portion 12. The annular flange 21 is configured to abut against an end of the sleeve 1 when the connecting member 20 is embedded in the sleeve 1. Considering the overall aesthetics of the electronic cigarette, an external diameter of the annular flange 21 is equal to the external diameter of the sleeve 1.

Figure 10A:
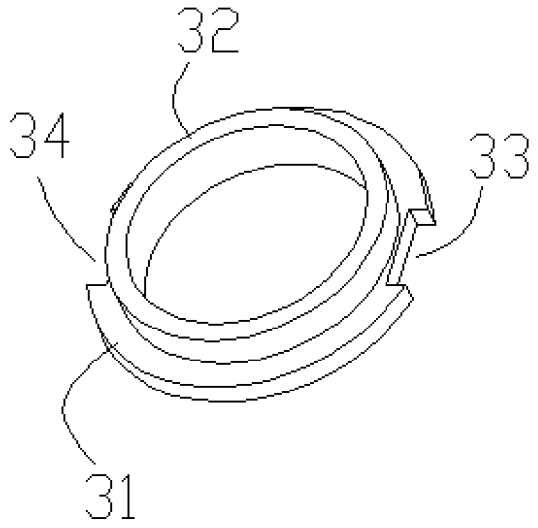
FIGS. 10A to 10B are respectively a perspective view and a front elevation view of a stopping block shown in FIG. 6.
Figure 10B:
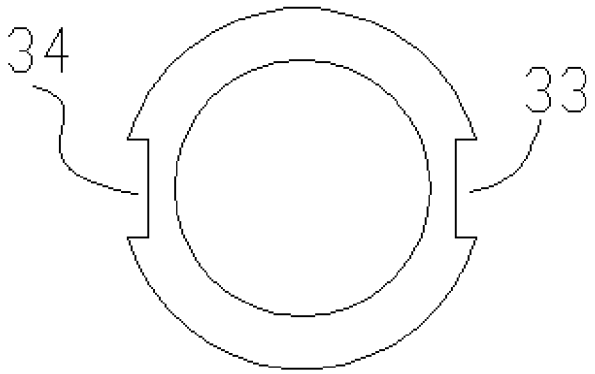

FIGS. 10A to 10B are respectively a perspective view and a front elevation view of a stopping block 30 shown in FIG. 6.

The stopping block 30 is coaxially fixed on an end of the connecting portion 12 away from the end cover 10. The stopping block 30 is configured to limit a distance of the connecting portion 10 extending out of the sleeve 1, so that the end cover 10 is prevented from being entirely screwed out of the sleeve 1.

The stopping block 30 is annular, and includes an external annular portion 31 and an internal annular portion 32 formed by gradually reducing a diameter of the external annular portion 31 along a radial direction of the external annular portion 31. When the distance of the end cover 10 extending out of the sleeve 1 reaches a critical distance, the external annular portion 31 abuts against an end of the connecting member 20. Therefore, an external diameter of the external annular portion 31 should be greater than an internal diameter of the connecting member 20. Considering that the rotation of the end cover 10 drives the stopping block 30 to rotate, an external diameter of the external annular portion 31 is designed to be less than the internal diameter of the sleeve 1 to reduce unnecessary friction resistance. The internal annular portion 32 is sleeved and fixed in the connecting portion 12. In order to enable the stopping block 30 to rotate along with the end cover 10, when the end cover 10 rotates, the internal annular portion 32 and the connecting portion 12 are designed to form interference fit. Besides, an annular recess 14 is defined in an inner surface of the connecting portion 12 facing the stopping block 30. The internal annular portion 32 is sleeved and fixed in the annular recess 14, and the internal annular portion 32 and the annular recess 14 form interference fit.

A first gap 33 and a second gap 34 are defined in a side edge of the external annular portion 31. The first charging electrode 101 and the second charging electrode 102 respectively pass through the first gap 33 and the second gap 34 to be connected to the controller 3 via the elastic conductive wires.

Figure 11:
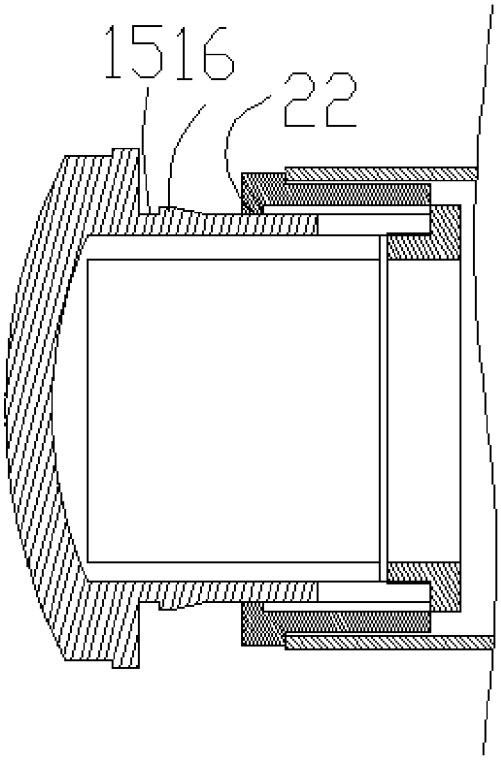
FIG. 11 is a local schematic view of an electronic cigarette of a second embodiment of the present application.

FIG. 11 is a local schematic view of an electronic cigarette of a second embodiment of the present application.

The difference between the second embodiment and the first embodiment is that the connecting portion 12 and the connecting member 20 of the battery assembly of the second embodiment are buckled with each other. A bulge 16 is formed on an outer surface of the connecting portion 12. A buckling recess 15 is formed between the bulge 16 and the cover body 11. A buckling block 15 corresponding to the buckling recess 22 is formed on a side surface of an end of the connecting member 20 and extends away from the sleeve 1 along a radial direction of the connecting member 20. In this embodiment, the end cover 10 is made of plastic.

In a normal state, the buckling block 22 is buckled in the buckling recess 15. When the electronic cigarette is charged, the end cover 10 is pressed and directly pulled out of the connecting member 20 longitudinally, so that the buckling block 22 is taken out of the buckling recess 15.

Figure 12:
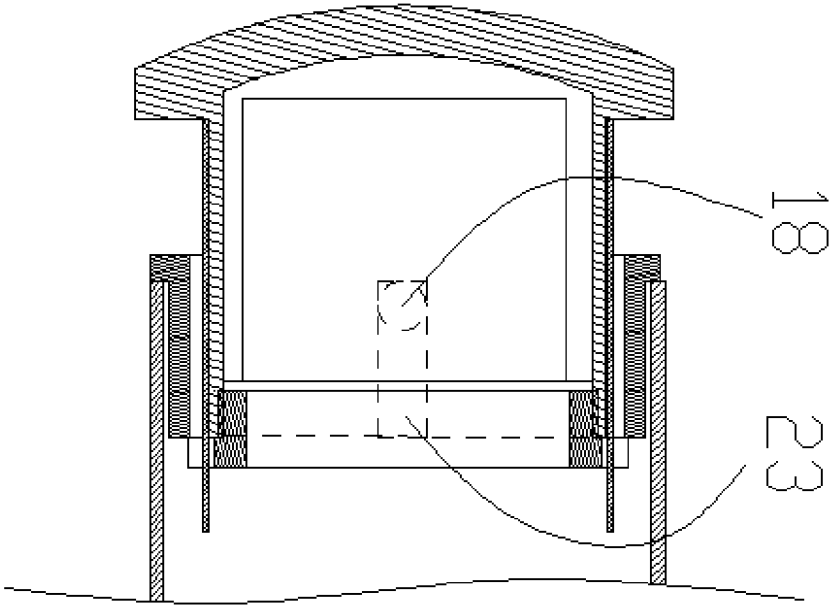
FIG. 12 is a local schematic view of an electronic cigarette of a third embodiment of the present application.

FIG. 12 is a local schematic view of an electronic cigarette of a third embodiment of the present application.

The difference between the third embodiment and the first embodiment is that that the connecting portion 12 and the connecting member of the battery assembly of the third embodiment are buckled with each other. A buckling pillar 18 is formed on an outer surface of the connecting portion 12 and extends away from the connecting portion 12 along a radial direction of the connecting portion 12. A guiding recess 23 configured to lead the buckling pillar 18 to radially slide is defined in the inner surface of the connecting member 20. A sliding distance of the buckling pillar 18 sliding in the guiding recess 23 is equal to a critical distance of the end cover 10 extending out of the sleeve 1.

In a normal state, the buckling pillar 18 abuts against a portion of an end of the connecting member 20 abutting the battery assembly that is far away from the opening of the guiding recess 23. When the electronic cigarette needs to be charged, the end cover 10 is rotated until the buckling pillar 18 is buckled with the guiding recess 23, and the end cover 10 is longitudinally pulled out of the connecting member 20, so that the buckling pillar 18 longitudinally slides in the guiding recess 23 along a direction away from the stopping block 30.

While the embodiments of the present application are described with reference to the accompanying drawings above, the present application is not limited to the above-mentioned specific implementations. In fact, the above-mentioned specific implementations are intended to be exemplary not to be limiting. In the inspiration of the present application, those ordinary skills in the art can also make many modifications without breaking away from the subject of the present application and the protection scope of the claims. All these modifications belong to the protection of the present application.

What is claimed is:

1. A battery assembly configured to cooperate with an atomizing assembly to form an electronic cigarette, wherein the electronic cigarette is defined in an electronic cigarette case which is provided with a printed circuit board; wherein the battery assembly comprising a sleeve; a battery disposed along an axial direction of the sleeve; an end cover mounted on an end of the sleeve; and a first charging electrode and a second charging electrode are mounted on the end cover and arranged in the sleeve;

wherein the end cover includes a cover body mounted on the sleeve and a connecting portion extending towards the sleeve along an axial direction of the cover body; and the first charging electrode and the second charging electrode are mounted on an outer surface of the connecting portion and spaced with each other; wherein the battery assembly further comprises a connecting member and a controller disposed between the sleeve and the connecting portion; the connecting member is received in the sleeve; an external thread is formed on the outer surface of the connecting portion, and an internal thread corresponding to the external thread is formed on an inner surface of the connecting member;

wherein the connecting member is connected to the connecting portion by threads in order to achieve that the end cover is telescopically connected to the sleeve;

wherein ends of the first charging electrode and the second charging electrode are connected to the controller respectively by spiral elastic conductive wires; other ends of the first charging electrode and the second charging electrode are exposed and connected to charging terminals of the printed circuit board when the end cover extends out of the sleeve, when the first charging electrode and the second charging electrode are exposed and connected to charging terminals of the printed circuit board, the electronic cigarette is placed inside the electronic cigarette case as a whole; and the controller configured for stopping the battery supplying electric power to the atomizing assembly and controlling an external power to charge the battery;

wherein the battery assembly further comprises a first accommodating house configured for accommodating the connecting portion, a second accommodating house configured for accommodating the controller, and a third accommodating house located between the first accommodating house and the second accommodating house and configured for accommodating the elastic conductive wires are formed between the battery and the end cover;

wherein an end of the first charging electrode abutting the third accommodating house and an end of the second charging electrode abutting the third accommodating house are respectively connected to the elastic conductive wires;

wherein both the first charging electrode and the second charging electrode run through the outer surface of the connecting portion axially, and extend from a side of the connecting portion away from the cover body;

wherein the first charging electrode and the second charging electrode are respectively a first electrode plate and a second electrode plate that are both mounted on the outer surface of the connecting portion;

wherein an annular flange is formed on a circumferential side surface of an end of the connecting member, and extends away from the connecting portion along a radial direction of the connecting portion; and the annular flange is configured to abut against the end of the sleeve when the connecting member is embedded in the sleeve;

wherein an external diameter of the annular flange is equal to an external diameter of the sleeve; and wherein the battery assembly further comprises a stopping block coaxially fixed on an end of the connecting portion away from the end cover, and the stopping block is configured to limit a distance of the connecting portion extending out of the sleeve.

2. An electronic cigarette comprising an atomizing assembly and a battery assembly, wherein, the battery assembly configured to cooperate with an atomizing assembly to form an electronic cigarette, wherein, the electronic cigarette is defined in an electronic cigarette case which is provided with a printed circuit board; wherein the battery assembly comprises a sleeve; a battery disposed along an axial direction of the sleeve an end cover mounted on an end of the sleeve; and a first charging electrode and a second charging electrode are mounted on the end cover and arranged in the sleeve;

wherein the end cover includes a cover body mounted on the sleeve and a connecting portion extending towards the sleeve along an axial direction of the cover body; and the first charging electrode and the second charging electrode are mounted on an outer surface of the connecting portion and spaced with each other; wherein the battery assembly further comprises a connecting member and a controller disposed between the sleeve and the connecting portion; the connecting member is received in the sleeve; an external thread is formed on the outer surface of the connecting portion, and an internal thread corresponding to the external thread is formed on an inner surface of the connecting member;

wherein the connecting member is connected to the connecting portion by threads in order to achieve that the end cover is telescopically connected to the sleeve;

wherein ends of the first charging electrode and the second charging electrode are connected to the controller respectively by spiral elastic conductive wires; other ends of the first charging electrode and the second charging electrode are exposed and connected to charging terminals of the printed circuit board when the end cover extends out of the sleeve, when the first charging electrode and the second charging electrode are exposed and connected to charging terminals of the printed circuit board, the electronic cigarette is placed inside the electronic cigarette case as a whole; and the controller configured for stopping the battery supplying electric power to the atomizing assembly and controlling an external power to charge the battery;

wherein the battery assembly further comprises a first accommodating house configured for accommodating the connecting portion, a second accommodating house configured for accommodating the controller, and a third accommodating house located between the first accommodating house and the second accommodating house and configured for accommodating the elastic conductive wires are formed between the battery and the end cover;

wherein an end of the first charging electrode abutting the third accommodating house and an end of the second charging electrode abutting the third accommodating house are respectively connected to the elastic conductive wires;

wherein both the first charging electrode and the second charging electrode run through the outer surface of the connecting portion axially, and extend from a side of the connecting portion away from the cover body;

wherein the first charging electrode and the second charging electrode are respectively a first electrode plate and a second electrode plate that are both mounted on the outer surface of the connecting portion;

wherein an annular flange is formed on a circumferential side surface of an end of the connecting member, and extends away from the connecting portion along a radial direction of the connecting portion; and the annular flange is configured to abut against the end of the sleeve when the connecting member is embedded in the sleeve;

wherein an external diameter of the annular flange is equal to an external diameter of the sleeve; and wherein the battery assembly further comprises a stopping block coaxially fixed on an end of the connecting portion away from the end cover, and the stopping block is configured to limit a distance of the connecting portion extending out of the sleeve.

* * * * *